US012295416B2

(12) United States Patent
Mikayama et al.

(10) Patent No.: US 12,295,416 B2
(45) Date of Patent: May 13, 2025

(54) AEROSOL-GENERATING DEVICE WITH ARTICLE LOCKING FOR HEATING

(71) Applicant: PHILIP MORRIS PRODUCTS S.A., Neuchatel (CH)

(72) Inventors: Takeshi Mikayama, Neuchatel (CH); Nicolas Frederic, Moret-Loing-et-Orvanne (FR); Poindron Cyrille, Cruseille (FR)

(73) Assignee: Philip Morris Products S.A., Neuchatel (CH)

( * ) Notice: Subject to any disclaimer, the term of this patent is extended or adjusted under 35 U.S.C. 154(b) by 720 days.

(21) Appl. No.: 17/599,813

(22) PCT Filed: Mar. 31, 2020

(86) PCT No.: PCT/EP2020/059127

§ 371 (c)(1),
(2) Date: Sep. 29, 2021

(87) PCT Pub. No.: WO2020/201285

PCT Pub. Date: Oct. 8, 2020

(65) Prior Publication Data

US 2022/0192262 A1 Jun. 23, 2022

(30) Foreign Application Priority Data

Apr. 2, 2019 (EP) ..... 19166800

(51) Int. Cl.
*A24F 40/42* (2020.01)
*A24F 40/46* (2020.01)
(Continued)

(52) U.S. Cl.
CPC ..... *A24F 40/42* (2020.01); *A24F 40/46* (2020.01); *A24F 40/51* (2020.01); *A24F 40/53* (2020.01)

(58) Field of Classification Search
None
See application file for complete search history.

(56) References Cited

U.S. PATENT DOCUMENTS 6,554,326 B1 * 4/2003 Goldman ..... E05B 47/0002 292/201
9,320,299 B2 * 4/2016 Hearn ..... A61M 15/06
(Continued)

OTHER PUBLICATIONS

Intrinsic Devices Incorporated "Active Fasteners." Intrinsicdevives.com Sep. 25, 2013 Apr. 9, 2024. [https://web.archive.org/web/20130925211259/https://www.intrinsicdevices.com/active_fasteners.html] (Year: 2024).*

(Continued)

*Primary Examiner* — Eric Yaary
*Assistant Examiner* — Virginia R Bieger
(74) *Attorney, Agent, or Firm* — Mueting Raasch Group

(57) ABSTRACT

According to the invention there is provided an aerosol-generating device comprising a receiving region configured to receive an aerosol-generating article comprising aerosol-generating substrate. The device further comprises an atomiser configured to heat the aerosol-generating substrate of the aerosol-generating article, when the aerosol-generating article is received in the receiving region. A locking element configured to securely hold the received aerosol-generating article in the receiving region and a controller are further provided. The controller is configured to control the locking element to hold the aerosol-generating article, when the atomiser is activated.

16 Claims, 9 Drawing Sheets

Figure 1:
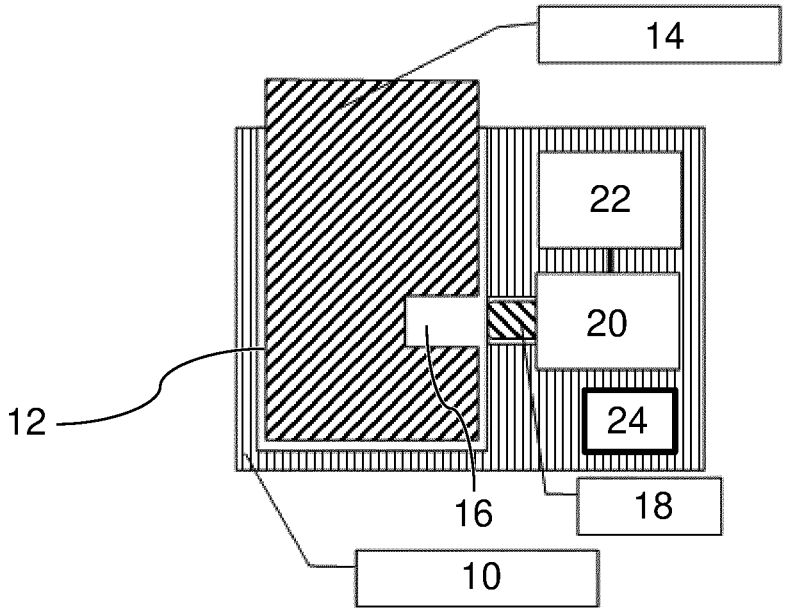

(51) Int. Cl.
*A24F 40/51* (2020.01)
*A24F 40/53* (2020.01)

(56) References Cited

U.S. PATENT DOCUMENTS

| | | | | |
|---|---|---|---|---|
| 9,848,647 | B2 * | 12/2017 | Memari | A24F 40/485 |
| 9,888,715 | B2 * | 2/2018 | Li | H01M 10/0525 |
| 2016/0302488 | A1 * | 10/2016 | Fernando | H02J 7/0042 |
| 2017/0095005 | A1 | 4/2017 | Monees | |
| 2017/0099877 | A1 * | 4/2017 | Worm | A24F 40/40 |

OTHER PUBLICATIONS

PCT International Search Report and Written Opinion for PCT/EP2020/059127 dated Jun. 15, 2020 (11 pages).

* cited by examiner

AEROSOL-GENERATING DEVICE WITH ARTICLE LOCKING FOR HEATING

This application is a U.S. National Stage Application of International Application No. PCT/EP2020/059127 filed Mar. 31, 2020, which was published in English on Oct. 8, 2020, as International Publication No. WO 2020/201285 A1. International Application No. PCT/EP2020/059127 claims priority to European Application No. 19166800.3 filed Apr. 2, 2019.

The present invention relates to an aerosol-generating device.

It is known to provide an aerosol-generating device for generating an inhalable vapor. Such devices may heat aerosol-generating substrate contained in an aerosol-generating article without burning the aerosol-generating substrate. The aerosol-generating article may be received in the aerosol-generating device, particularly an atomising chamber of the aerosol-generating device. An atomiser is arranged in or around the atomising chamber for heating the aerosol-generating substrate once the aerosol-generating article is inserted into the atomising chamber of the aerosol-generating device. Typically, the aerosol-generating article is inserted into the aerosol-generating device by a user. During insertion or during use, an aerosol-generating article may not be correctly inserted or may shift from the initial position. Also, a user may remove an aerosol-generating article before the aerosol generating operation is finalized. The aerosol generation may be influenced in an improper way, if the aerosol-generating article is not received in the aerosol-generating device as designated.

It would be desirable for an aerosol-generating device to prevent improper change in the position of a received aerosol-generating article.

According to an aspect of the invention there is provided an aerosol-generating device comprising a receiving region configured to receive an aerosol-generating article comprising aerosol-generating substrate. The device further comprises an atomiser configured to atomize the aerosol-generating substrate of the aerosol-generating article, when the aerosol-generating article is received in the receiving region. A locking element configured to securely hold the received aerosol-generating article in the receiving region and a controller are further provided. The controller is configured to control the locking element to hold the aerosol-generating article, when the atomiser is activated.

The present invention facilitates secure holding of the aerosol-generating article in the receiving region during operation of the aerosol-generating device, more precisely during operation of the atomiser. In this regard, the locking element holding the aerosol-generating article prevents the positional displacement of the aerosol-generating article. For example, the aerosol-generating article could disengage from the atomiser. The aerosol-generating article could potentially fall out of the receiving region. Even if the aerosol-generating article would not fully fall out of the receiving region and thus disengage from the aerosol-generating device, a positional displacement of the aerosol-generating article could potentially negatively impair the atomisation of the aerosol-generating substrate contained in the aerosol-generating article by means of the atomiser. Hence, aerosol generation may be optimized by holding the aerosol-generating article. Holding the aerosol-generating article in a correct position may prevent malfunction of the atomiser such as overheating or low-efficient atomization of the atomiser. In this regard, if the aerosol-generating article moves during operation, the atomiser may no longer be in optimal contact with the aerosol-generating substrate contained in the aerosol-generating article. In such an incorrect position of the aerosol-generating article, diminished contact between the atomiser and the aerosol-generating substrate may lead to the atomiser malfunctioning. This is prevented by locking the aerosol-generating article in place. Furthermore, a waste of the aerosol-generating article may be prevented. In this regard, repositioning of the aerosol-generating article may lead to undesired atomisation of the aerosol-generating substrate of the aerosol-generating article or to the aerosol-generating article disengaging from the receiving region of the aerosol-generating device. In both cases, the aerosol-generating article may be lost and a user may have to insert a new aerosol-generating article into the receiving region. The loss of an aerosol-generating article, which aerosol-generating substrate is not fully depleted yet, may be prevented by locking the aerosol-generating article in place by means of the locking element.

As used herein, the term 'aerosol-generating device' relates to a device that interacts with an aerosol-generating substrate to generate an aerosol. The aerosol-generating substrate may be part of an aerosol-generating article, for example part of a smoking article. An aerosol-generating device may be a smoking device that interacts with an aerosol-generating substrate of an aerosol-generating article to generate an aerosol that is directly inhalable into a user's lungs through the user's mouth. An aerosol-generating device may be a holder.

The device is preferably a portable or handheld device that is comfortable to hold between the fingers of a single hand. The device may be substantially cylindrical in shape and has a length of between 70 and 120 mm. The maximum diameter of the device is preferably between 10 and 20 mm. In one embodiment the device has a polygonal cross section and has a protruding button formed on one face. In this embodiment, the diameter of the device is between 12.7 and 13.65 mm taken from a flat face to an opposing flat face; between 13.4 and 14.2 mm taken from an edge to an opposing edge (i.e., from the intersection of two faces on one side of the device to a corresponding intersection on the other side), and between 14.2 and 15 mm taken from a top of the button to an opposing bottom flat face.

The device may be an electrically heated smoking or vaping device. The device may be an electrically smoking or vaping device that generates aerosol by mechanical vibration or spraying.

As used herein, the term 'aerosol-generating article' refers to an article comprising an aerosol-generating substrate that is capable of releasing volatile compounds that can form an aerosol. For example, an aerosol-generating article may be a smoking article that generates an aerosol that is directly inhalable into a user's lungs through the user's mouth. An aerosol-generating article may be disposable. A smoking article comprising an aerosol-generating substrate comprising tobacco is referred to as a tobacco stick.

The aerosol-generating article may be substantially cylindrical in shape. The aerosol-generating article may be substantially elongate. The aerosol-generating article may have a length and a circumference substantially perpendicular to the length. The aerosol-generating substrate may be substantially cylindrical in shape. The aerosol-generating substrate may be substantially elongate. The aerosol-generating substrate may also have a length and a circumference substantially perpendicular to the length.

The aerosol-generating article may have a total length between approximately 30 mm and approximately 100 mm. The aerosol-generating article may have an external diameter between approximately 5 mm and approximately 12 mm. The aerosol-generating article may comprise a filter plug. The filter plug may be located at a downstream end of the aerosol-generating article. The filter plug may be a cellulose acetate filter plug. The filter plug is approximately 7 mm in length in one embodiment, but may have a length of between approximately 5 mm to approximately 10 mm.

In one embodiment, the aerosol-generating article has a total length of approximately 45 mm. The aerosol-generating article may have an external diameter of approximately 7.2 mm. Further, the aerosol-generating substrate may have a length of approximately 10 mm. Alternatively, the aerosol-generating substrate may have a length of approximately 12 mm. Further, the diameter of the aerosol-generating substrate may be between approximately 5 mm and approximately 12 mm. The aerosol-generating article may comprise an outer paper wrapper. Further, the aerosol-generating article may comprise a separation between the aerosol-generating substrate and the filter plug. The separation may be approximately 18 mm, but may be in the range of approximately 5 mm to approximately 25 mm.

Alternatively, the aerosol-generating article may be configured as a cartridge. A cartridge is particularly preferred, if the aerosol-generating substrate is provided as liquid aerosol-generating substrate. The liquid aerosol-generating substrate may be contained in a liquid storage portion of the cartridge. The liquid storage portion is adapted for storing the liquid aerosol-generating substrate to be supplied to the atomiser of the aerosol-generating device. Alternatively, the cartridge itself could comprise an atomiser for vaporizing the liquid aerosol-generating substrate. In this case, the aerosol-generating device may not comprise an atomiser but only supply electrical energy towards the atomiser of the cartridge, when the cartridge is received by the aerosol-generating device. The liquid storage portion may comprise couplings such as self-healing pierceable membranes for facilitating supply of the liquid aerosol-generating substrate towards the atomiser. The membranes avoid undesired leaking of the liquid aerosol-generating substrate stored in the liquid storage portion. A respective needle-like hollow tube may be provided to pierce through the membrane. The liquid storage portion may be configured as a replaceable tank or container.

The cartridge may have any suitable shape and size. For example, the cartridge may be substantially cylindrical. The cross-section of the cartridge may, for example, be substantially circular, elliptical, square or rectangular.

The cartridge may comprise a housing. The housing may comprise a base and one or more sidewalls extending from the base. The base and the one or more sidewalls may be integrally formed. The base and one or more sidewalls may be distinct elements that are attached or secured to each other. The housing may be a rigid housing. As used herein, the term 'rigid housing' is used to mean a housing that is self-supporting. The rigid housing of the cartridge may provide mechanical support to the atomiser. The cartridge may comprise one or more flexible walls. The flexible walls may be configured to adapt to the volume of the liquid aerosol-generating substrate stored in the cartridge. Preferably, the cartridge comprises, as described above, a liquid storage portion, which may comprise the flexible wall. The cartridge may comprise a rigid housing, while a liquid storage portion comprising a flexible wall may be housed within the rigid housing. The housing of the cartridge may comprise any suitable material. The cartridge may comprise substantially fluid impermeable material. The housing of the cartridge may comprise a transparent or a translucent portion, such that liquid aerosol-generating substrate stored in the cartridge may be visible to a user through the housing. The cartridge may be configured such that aerosol-generating substrate stored in the cartridge is protected from ambient air. The cartridge may be configured such that aerosol-generating substrate stored in the cartridge is protected from light. This may reduce the risk of degradation of the substrate and may maintain a high level of hygiene.

The liquid aerosol-generating substrate may be absorbed into a porous carrier material. The porous carrier material may be made from any suitable absorbent plug or body, for example, a foamed metal or plastics material, polypropylene, terylene, nylon fibres or ceramic. The liquid aerosol-generating substrate may be retained in the porous carrier material prior to use of the aerosol-generating device or alternatively, the liquid aerosol-generating substrate material may be released into the porous carrier material during, or immediately prior to use.

The cartridge may be substantially sealed. The cartridge may comprise one or more outlets for liquid aerosol-generating substrate stored in the cartridge to flow from the cartridge to the aerosol-generating device. The cartridge may comprise one or more semi-open inlets. This may enable ambient air to enter the cartridge. The one or more semi-open inlets may be semi-permeable membranes or one-way valves, permeable to allow ambient air into the cartridge and impermeable to substantially prevent air and liquid inside the cartridge from leaving the cartridge. The one or more semi-open inlets may enable air to pass into the cartridge under specific conditions. The cartridge may be refillable. Alternatively, the cartridge may be configured as a replaceable cartridge. The aerosol-generating device may be configured for receiving the cartridge. A new cartridge may be attached to the aerosol-generating device when the initial cartridge is spent.

As used herein, the term 'aerosol-generating substrate' relates to a substrate capable of releasing volatile compounds that can form an aerosol. Such volatile compounds may be released by heating the aerosol-generating substrate. An aerosol-generating substrate may conveniently be part of an aerosol-generating article or the aerosol-generating article.

The aerosol-generating substrate may be a solid aerosol-generating substrate. Alternatively, the aerosol-generating substrate may comprise both solid and liquid components. As a further alternative, the aerosol-generating substrate may be provided in a liquid form. As described above, liquid aerosol-generating substrate is preferably used in conjunction with a cartridge comprising a liquid storage portion. The aerosol-generating substrate may comprise a tobacco-containing material containing volatile tobacco flavour compounds which are released from the substrate upon atomization. Alternatively, the aerosol-generating substrate may comprise a non-tobacco material. The aerosol-generating substrate may further comprise an aerosol former that facilitates the formation of a dense and stable aerosol. Examples of suitable aerosol formers are glycerine and propylene glycol.

If the aerosol-generating substrate is a solid aerosol-generating substrate, the solid aerosol-generating substrate may comprise, for example, one or more of: powder, granules, pellets, shreds, spaghettis, strips or sheets containing one or more of: herb leaf, tobacco leaf, fragments of tobacco ribs, reconstituted tobacco, homogenised tobacco, extruded tobacco, cast leaf tobacco and expanded tobacco. The solid aerosol-generating substrate may be in loose form, or may be provided in a suitable container or cartridge. Optionally, the solid aerosol-generating substrate may contain additional tobacco or non-tobacco volatile flavour compounds, to be released upon atomisation of the substrate. The solid aerosol-generating substrate may also contain capsules that, for example, include the additional tobacco or non-tobacco volatile flavour compounds and such capsules may melt during heating of the solid aerosol-generating substrate.

As used herein, homogenised tobacco refers to material formed by agglomerating particulate tobacco. Homogenised tobacco may be in the form of a sheet. Homogenised tobacco material may have an aerosol-former content of greater than 5% on a dry weight basis. Homogenised tobacco material may alternatively have an aerosol former content of between 5% and 30% by weight on a dry weight basis. Sheets of homogenised tobacco material may be formed by agglomerating particulate tobacco obtained by grinding or otherwise combining one or both of tobacco leaf lamina and tobacco leaf stems. Alternatively, or in addition, sheets of homogenised tobacco material may comprise one or more of tobacco dust, tobacco fines and other particulate tobacco by-products formed during, for example, the treating, handling and shipping of tobacco. Sheets of homogenised tobacco material may comprise one or more intrinsic binders, that is tobacco endogenous binders, one or more extrinsic binders, that is tobacco exogenous binders, or a combination thereof to help agglomerate the particulate tobacco; alternatively, or in addition, sheets of homogenised tobacco material may comprise other additives including, but not limited to, tobacco and non-tobacco fibres, aerosol-formers, humectants, plasticisers, flavourants, fillers, aqueous and non-aqueous solvents and combinations thereof.

Optionally, the solid aerosol-generating substrate may be provided on or embedded in a thermally stable carrier. The carrier may take the form of powder, granules, pellets, shreds, spaghettis, strips or sheets. Alternatively, the carrier may be a tubular carrier having a thin layer of the solid substrate deposited on its inner surface, or on its outer surface, or on both its inner and outer surfaces. Such a tubular carrier may be formed of, for example, a paper, or paper like material, a non-woven carbon fibre mat, a low mass open mesh metallic screen, or a perforated metallic foil or any other thermally stable polymer matrix.

In a particularly preferred embodiment, the aerosol-generating substrate comprises a gathered crimpled sheet of homogenised tobacco material. As used herein, the term 'crimped sheet' denotes a sheet having a plurality of substantially parallel ridges or corrugations. Preferably, when the aerosol-generating article has been assembled, the substantially parallel ridges or corrugations extend along or parallel to the longitudinal axis of the aerosol-generating article. This advantageously facilitates gathering of the crimped sheet of homogenised tobacco material to form the aerosol-generating substrate. However, it will be appreciated that crimped sheets of homogenised tobacco material for inclusion in the aerosol-generating article may alternatively or in addition have a plurality of substantially parallel ridges or corrugations that are disposed at an acute or obtuse angle to the longitudinal axis of the aerosol-generating article when the aerosol-generating article has been assembled. In certain embodiments, the aerosol-generating substrate may comprise a gathered sheet of homogenised tobacco material that is substantially evenly textured over substantially its entire surface. For example, the aerosol-generating substrate may comprise a gathered crimped sheet of homogenised tobacco material comprising a plurality of substantially parallel ridges or corrugations that are substantially evenly spaced-apart across the width of the sheet.

The solid aerosol-generating substrate may be deposited on the surface of the carrier in the form of, for example, a sheet, foam, gel or slurry. The solid aerosol-generating substrate may be deposited on the entire surface of the carrier, or alternatively, may be deposited in a pattern in order to provide a non-uniform flavour delivery during use.

If the aerosol-generating substrate is provided in liquid form in the liquid aerosol-generating substrate certain physical properties, for example the vapor pressure or viscosity of the substrate, are chosen in a way to be suitable for use in the aerosol generating system. The liquid preferably comprises a tobacco-containing material comprising volatile tobacco flavour compounds which are released from the liquid upon heating. Alternatively, or in addition, the liquid may comprise a non-tobacco material. The liquid may include water, ethanol, or other solvents, plant extracts, nicotine solutions, and natural or artificial flavours. Preferably, the liquid further comprises an aerosol former. Examples of suitable aerosol formers are glycerine and propylene glycol.

The aerosol-generating device may comprise electric circuitry. The electric circuitry may be configured as the controller of the electric circuitry may comprise the controller. The electric circuitry may comprise a microprocessor, which may be a programmable microprocessor. The microprocessor may be part of the controller. The electric circuitry may comprise further electronic components. The electric circuitry may be configured to regulate a supply of power to the atomiser. Power may be supplied to the atomiser continuously following activation of the system or may be supplied intermittently, such as on a puff-by-puff basis. The power may be supplied to the atomiser in the form of pulses of electrical current. If the atomizer is a heating element, the electric circuitry may be configured to monitor the electrical resistance of the heating element, and preferably to control the supply of power to the vaporiser dependent on the electrical resistance of the heating element.

The aerosol-generating device may comprise a power supply, typically a battery. As an alternative, the power supply may be another form of charge storage device such as a capacitor. The power supply may require recharging and may have a capacity that enables to store enough energy for one or more uses; for example, the power supply may have sufficient capacity to continuously generate aerosol for a period of around six minutes or for a period of a multiple of six minutes. In another example, the power supply may have sufficient capacity to provide a predetermined number of puffs or discrete activations of the atomiser.

The atomiser may be any device suitable for atomising the aerosol-generating substrate and vaporize at least a part of the aerosol-generating substrate in order to form an inhalable aerosol. The atomiser may be a heating element, aerosol spray or SAW (Surface Acoustic Wave) aerosol generator. The atomiser may exemplarily be a coil heater, a capillary tube heater, a mesh heating element or a metal plate heater. The atomiser may exemplarily be a resistive heating element which receives electrical power and transforms at least part of the received electrical power into heat energy. Alternatively, or in addition, the atomiser may be a susceptor that is inductively heated by a time varying magnetic field. The atomiser may comprise only a single heating element or a plurality of heating elements. The temperature of the heating element or elements is preferably controlled by electric circuitry.

In all of the aspects of the disclosure, the atomiser may comprise an electrically resistive material. Suitable electrically resistive materials include but are not limited to:

semiconductors such as doped ceramics, electrically "conductive" ceramics (such as, for example, molybdenum disilicide), carbon, graphite, metals, metal alloys and composite materials made of a ceramic material and a metallic material. Such composite materials may comprise doped or undoped ceramics. Examples of suitable doped ceramics include doped silicon carbides. Examples of suitable metals include titanium, zirconium, tantalum platinum, gold and silver. Examples of suitable metal alloys include stainless steel, nickel-, cobalt-, chromium-, aluminium- titanium- zirconium-, hafnium-, niobium-, molybdenum-, tantalum-, tungsten-, tin-, gallium-, manganese-, gold- and iron-containing alloys, and super-alloys based on nickel, iron, cobalt, stainless steel, Timetal® and iron-manganese-aluminium based alloys. In composite materials, the electrically resistive material may optionally be embedded in, encapsulated or coated with an insulating material or vice-versa, depending on the kinetics of energy transfer and the external physicochemical properties required.

The atomiser may be part of an aerosol-generating device. The aerosol-generating device may comprise an internal atomiser or an external atomiser, or both internal and external atomisers, where "internal" and "external" refer to the aerosol-generating substrate. An internal atomiser may take any suitable form. For example, an internal atomiser may take the form of a heating blade. Alternatively, the internal heater may take the form of a casing or substrate having different electro-conductive portions, or an electrically resistive metallic tube. Alternatively, the internal atomiser may be one or more heating needles or rods that run through the center of the aerosol-generating substrate. Other alternatives include a heating wire or filament, for example a Ni—Cr (Nickel-Chromium), platinum, tungsten or alloy wire or a heating plate. Optionally, the internal atomiser may be deposited in or on a rigid carrier material. In one such embodiment, the electrically resistive atomiser may be formed using a metal having a defined relationship between temperature and resistivity. In such an exemplary device, the metal may be formed as a track on a suitable insulating material, such as ceramic material, and then sandwiched in another insulating material, such as a glass. Heaters formed in this manner may be used to both heat and monitor the temperature of the atomisers during operation.

An external atomiser may take any suitable form. For example, an external atomiser may take the form of one or more flexible heating foils on a dielectric substrate, such as polyimide. The flexible heating foils can be shaped to conform to the perimeter of the substrate receiving cavity. Alternatively, an external atomiser may take the form of a metallic grid or grids, a flexible printed circuit board, a molded interconnect device (MID), ceramic heater, flexible carbon fibre heater or may be formed using a coating technique, such as plasma vapor deposition, on a suitable shaped substrate. An external atomiser may also be formed using a metal having a defined relationship between temperature and resistivity. In such an exemplary device, the metal may be formed as a track between two layers of suitable insulating materials. An external atomiser formed in this manner may be used to both heat and monitor the temperature of the external atomiser during operation.

The internal or external atomiser may comprise a heat sink, or heat reservoir comprising a material capable of absorbing and storing heat and subsequently releasing the heat over time to the aerosol-generating substrate. The heat sink may be formed of any suitable material, such as a suitable metal or ceramic material. In one embodiment, the material has a high heat capacity (sensible heat storage material), or is a material capable of absorbing and subsequently releasing heat via a reversible process, such as a high temperature phase change. Suitable sensible heat storage materials include silica gel, alumina, carbon, glass mat, glass fibre, minerals, a metal or alloy such as aluminium, silver or lead, and a cellulose material such as paper. Other suitable materials which release heat via a reversible phase change include paraffin, sodium acetate, naphthalene, wax, polyethylene oxide, a metal, metal salt, a mixture of eutectic salts or an alloy. The heat sink or heat reservoir may be arranged such that it is directly in contact with the aerosol-generating substrate and can transfer the stored heat directly to the substrate. Alternatively, the heat stored in the heat sink or heat reservoir may be transferred to the aerosol-generating substrate by means of a heat conductor, such as a metallic tube.

The atomiser advantageously heats the aerosol-generating substrate by means of conduction. The atomiser may be at least partially in contact with the substrate, or the carrier on which the substrate is deposited. Alternatively, the heat from either an internal or external atomiser may be conducted to the substrate by means of a heat conductive element.

During operation, the aerosol-generating substrate may be completely contained within the aerosol-generating device. In that case, a user may puff on a mouthpiece of the aerosol-generating device. Alternatively, during operation the aerosol-generating article containing the aerosol-generating substrate may be partially contained within the aerosol-generating device. In that case, the user may puff directly on the aerosol-generating article.

The receiving region may preferably be configured as an atomising chamber. The receiving region may be configured as a cavity. The atomising chamber may have the shape of the cavity. The receiving region may be cylindrical. The receiving region may have a base. The base may have a circular shape. The receiving region may have a circular cross-section. The cross-section of the receiving region may alternatively have a different shape such as a rectangular shape. The receiving region preferably has a longitudinal extension so that an aerosol-generating article can be inserted into the receiving region.

The locking element may be configured to securely hold the received aerosol-generating article in the receiving region in a specific position.

During operation, it may be desired to position the aerosol-generating article in a desired optimal operation position. This desired optimal operation position may be facilitated by means of the locking element. In this regard, the locking element may be configured to hold the aerosol-generating article in this desired optimal operation position during the usage of the aerosol-generating device. For facilitating holding the aerosol-generating article in this desired optimal operation position, the aerosol-generating article may comprise a shape which facilitates a keyed insertion of the aerosol-generating article into the receiving region of the aerosol-generating device. For example, the cross-section of the aerosol-generating article may deviate from a symmetrical circular cross-section. The cross-section of the receiving region may correspond to the cross-section of the aerosol-generating article so that the aerosol-generating article can only be inserted into the receiving region in a specific orientation. Alternatively, the locking element may be configured to only lock the aerosol-generating article in place, if the aerosol-generating article is oriented and positioned in a specific way. For example, as will be described in more detail below, the locking element may comprise a piston. The piston may act as a male locking element. The aerosol-generating article may comprise a corresponding female locking element. Only if the male locking element, for example a piston, of the locking element aligns with the female locking element of the aerosol-generating article, the locking element can lock the aerosol-generating article in place. In other words, a user may have to insert the aerosol-generating article in an orientation, which corresponds to the optimal desired operation position of the aerosol-generating article, and wherein only if the user inserts the aerosol-generating article in this orientation, the looking element may be configured to enable locking of the aerosol-generating article in place.

The controller may be configured to control the locking element to release the aerosol-generating article, when the atomiser is deactivated.

After a typical operation, meaning after a certain amount of draws of a user, the aerosol-generating substrate in the aerosol-generating article is depleted. After that, a user may want to remove the aerosol-generating article from the receiving region of the aerosol-generating device. In this case, the aerosol-generating device, particularly the controller, may be configured to operate the locking element so that the aerosol-generating article can be removed from the receiving region of the aerosol-generating device. Preferably, the controller automatically disengages the locking element from the aerosol-generating article, after operation of the aerosol-generating device, more particularly after depletion of the aerosol-generating article. The controller may detect depletion of the aerosol-generating article after a predetermined amount of draws of the user, for example between 6 and 10 draws of the user. Alternatively, a user may manually disengage the locking element from the aerosol-generating article. In this regard, the aerosol-generating device may comprise a disengaging means such as a button. Also, a user may operate the controller to disengage the locking element from the aerosol-generating article. For this purpose, again a button may be used. Alternatively or additionally, further disengaging means may be provided. For example, the aerosol-generating device may comprise a communication interface, wherein the communication interface may be connected with the controller and further connected with an external device such as a smartphone. A user may then control the aerosol-generating device, particularly the disengagement of the locking element from the aerosol-generating article by means of the external device. For example, a smartphone with a display may be used to control the operation of the aerosol-generating device, more particularly the disengagement of the locking element from the aerosol-generating article. Releasing the aerosol-generating article, when the atomiser is deactivated facilitates secure holding of the aerosol-generating article for the full activation cycle of the atomiser.

The controller may be configured to control the locking element to release the aerosol-generating article, when the atomiser is deactivated and a predetermined time has elapsed.

Waiting for disengagement of the aerosol-generating article for a predetermined time may have the advantage that the aerosol-generating article as well as the atomiser may cool down to a sufficient degree. In this regard, it may be unpleasant for a user to remove an aerosol-generating article, which is heated to a specific operating temperature. The aerosol-generating article may be too hot for touching the aerosol-generating article. By waiting the predetermined amount of time, the aerosol-generating article may cool down sufficiently to be held by a user between his fingers. Similarly, the atomiser may be heated, during operation of the atomiser, to a temperature which is too high for a user, if a user would come into contact with the atomiser. Preferably, the atomiser cannot directly be touched by a user. Preferably, the atomiser is arranged in the receiving region of the aerosol-generating device in a way that the receiving region blocks the user from touching the atomiser. However, in other embodiments the atomiser may be accessible for user, at least partially. In all of these cases, it may be desirable to allow cooling down of the atomiser before removal of the aerosol-generating article. This is facilitated by waiting for the predetermined time before the controller controls the locking element to release the aerosol-generating article. The predetermined time may be between 0.5 seconds and 20 seconds, more preferably between 1 second and 10 seconds, most preferred around 3 seconds.

The controller may be configured to prevent one or more of activation and operation of the atomiser, if the locking element is unable to securely hold the received aerosol-generating article in the receiving region.

If the locking element is unable to securely hold the aerosol-generating article, it may be detected that the aerosol-generating article is in an incorrect position. In other words, the aerosol-generating article may not be positioned in a desired optimal operation position, if the locking element is unable to securely hold the aerosol-generating article. If the controller thus detects that the locking element has not locked the aerosol-generating article in place, the controller may detect that the aerosol-generating article is in an incorrect position. As a consequence, the controller may prevent activation of the atomiser. Additionally or alternatively, the controller may control a warning element to output a warning signal to a user. Upon perceiving the warning signal, a user may reposition the aerosol-generating article. The warning signal may be an optical, haptic or acoustic warning signal.

The device further may comprise an article sensor configured to detect whether the aerosol-generating article is received in the receiving region.

The article sensor may be configured as a sensor detecting the position of the aerosol-generating device. Hence, the article sensor may be configured as a position sensor. Preferably, the article sensor may be configured as a proximity sensor, more preferably a Hall effect sensor. Such a sensor may detect the distance between the current position of the aerosol-generating article and a desired optimal operation position of the aerosol-generating article, when the aerosol-generating article is received in the receiving region. If the distance between the current position of the aerosol-generating article and a desired optimal operation position is below a predetermined threshold, the article sensor may detect that the aerosol-generating article is in the desired optimal operation position. If the distance between the current position of the aerosol-generating article and the desired optimal operation position is larger than a predetermined threshold, the article sensor may detect that the aerosol-generating article is in an incorrect position. In this case, activation of the atomiser may be prevented by the controller. Furthermore, the warning signal as described above may be generated to indicate a user that the aerosol-generating article is in an incorrect position. Initial activation of the atomiser may be enabled, if the aerosol-generating article is positioned in the desired optimal operation position for the first time. After that, repositioning of the aerosol-generating article may be detected by the article sensor during operation of the aerosol-generating device. In this regard, typically the locking element would prevent repositioning of the aerosol-generating article during operation of the aerosol-generating device due to holding the aerosol-generating article in the desired optimal operation position. As a redundant safety means, the article sensor may additionally detect the position of the aerosol-generating article. In case the article sensor is configured as a Hall effect sensor, an electric field generating element may be provided in the aerosol-generating article and a hall sensor may be provided at or near the receiving region of the aerosol-generating device so that the distance between the aerosol-generating article, more precisely the magnetic field generating means in the aerosol-generating article, and the hall sensor in the aerosol-generating device can be detected by the Hall effect sensor.

The controller may be configured to control the locking element to hold the aerosol-generating article, when the atomiser is activated and when the article sensor detects that the aerosol-generating article is received in the receiving region.

According to this aspect, operation of the locking element is connected with the detection of the position of the aerosol-generating article by means of the article sensor. In this regard, as described above, the article sensor may detect whether the aerosol-generating article is positioned in the desired optimal operation position. If the article sensor detects that the aerosol-generating article is positioned in the desired optimal operation position, the article sensor may generate a corresponding output and the controller may be configured to enable the locking element to lock the aerosol-generating article in this desired optimal operation position. As also described above, the controller may then allow activation of the atomiser. Thus, the article sensor may act to confirm the position of the aerosol-generating article.

The controller may be configured to prevent activation of the atomiser, if the article sensor detects that the aerosol-generating article is not received in the receiving region.

Hence, the controller may prevent operation of the atomiser, if the article sensor does not detect that the aerosol-generating article is positioned in the desired optimal operation position. Alternatively or additionally, the controller may prevent operation of the atomiser, if the locking element cannot securely hold the aerosol-generating article in place. This may also mean that the aerosol-generating article is not positioned in the desired optimal operation position. Both of these functionalities could be employed at the same time. Hence, activation of the atomiser may only be enabled if the aerosol-generating article is detected by the article sensor to be in the desired optimal operation position and at the same time if the locking element can engage with the aerosol-generating article to securely hold the aerosol-generating article in the desired optimal operation position.

The device further may comprise a mechanical unlock safety element which may be configured to enable mechanical unlocking of the locking element.

The mechanical unlock safety element may enable removal of the aerosol-generating article, the locking element jams or malfunctions. In this case, a user may manually use of the mechanical unlock safety element to disengage the locking element from the aerosol-generating article so that the aerosol-generating article can be removed from the receiving region of the aerosol-generating device. The mechanical unlock safety element may be hidden, for example inside of the aerosol-generating device, so that the user may not accidentally activate the mechanical unlock safety element. Access to the mechanical unlock safety element may be possible by means of a small aperture, which may only be accessible by means of a small pin such as from a paperclip.

The locking element may be configured to enable transfer of electrical energy from the aerosol-generating device to the aerosol-generating article, when the locking element securely holds the received aerosol-generating article in the receiving region.

The locking element may in other words act as a locking element and at the same time act as electrical contact to enable transfer of electrical energy from the aerosol-generating device to the aerosol-generating article. As described above, the aerosol-generating device may comprise a power supply such as a battery. Instead of the aerosol-generating device comprising the atomiser, as described so far, the atomiser may be provided in the aerosol-generating article. Particularly if the aerosol-generating article is configured as a cartridge, the cartridge may comprise the atomiser. For example, the cartridge may utilize liquid aerosol-generating substrate contained in the liquid storage portion of the cartridge. The atomiser such as a mesh heater may be arranged adjacent the liquid storage portion. The liquid aerosol-generating substrate may be wicked towards the mesh heater by means of the atomiser, particularly comprising capillary material. If the cartridge is received in the receiving region of the aerosol-generating device, transfer of electrical energy from the power supply of the aerosol-generating device towards the atomiser of the cartridge may be enabled. If, for the transfer of electrical energy from the aerosol-generating device to the cartridge, the locking element is utilized, separate electrical contacts are not necessary. Hence, the aerosol-generating device as well as the cartridge can be constructed in a simpler, more efficient and more cost-effective way. The controller may allow transfer of electrical energy from the aerosol-generating device to the cartridge, if the locking element is able to securely hold the cartridge in the receiving region. Additionally or alternatively, an article sensor as described above may be provided to confirm that the cartridge is received in the receiving region in the desired optimal operation position. The article sensor may be employed in addition or alternatively to the confirmation by the locking element that the cartridge is positioned in the desired optimal operation position.

The locking element may be electrically operated and may utilize a common electric circuit with the atomiser.

The operation of the locking element may be electrical. The locking action of the locking element may facilitate it by electrical operation. The atomiser, as discussed above, is preferably an electrical atomiser such as a resistive atomiser, an induction atomiser, an aerosol spray or a SAW aerosol generator. If both the locking element and the atomiser are electrically operated, the construction of the aerosol-generating device can be simplified by using the same electric circuit for the locking element as well as for the atomiser. For example, initially the electric circuit comprising the locking element as well as the atomiser may be utilized to activate the locking element for securely holding the aerosol-generating article in the receiving region in the desired optimal operation position. Afterwards, operation of the atomiser may be enabled by means of the same electric circuit. Hence, simple construction may be facilitated thereby saving costs.

The locking element may be electrically operated and may comprise a piston movable in a lateral direction into a female cavity of the aerosol-generating article for securely holding the received aerosol-generating article in the receiving region. The piston may have any desired shape. Preferably the piston has a cylindrical shape.

This aspect is a first alternative of the realization of the locking element. In this case, the locking element comprises a movable piston. The piston is preferably movable in a lateral direction. The lateral direction is a direction perpendicular to the longitudinal axis of the aerosol-generating device. The longitudinal axis of the aerosol-generating device is parallel to the longitudinal axis of the receiving region. In this regard, as described above, the receiving region preferably is configured as an atomising chamber in the form of a cavity with a longitudinal extension and preferably a cylindrical shape. That the piston is laterally movable means that the piston, engaging the female cavity in the aerosol-generating article, moves perpendicular to the longitudinal axis of the receiving region, wherein the aerosol-generating article can be inserted along the longitudinal axis of the receiving region into the receiving region. This movement of the aerosol-generating article along the longitudinal axis of the receiving region can be prevented by the movable piston of the locking element engaging with the female cavity of the aerosol-generating article. As described above, a keyed arrangement between the locking element and the aerosol-generating article may be desired to hold the aerosol-generating article in a specific orientation. Hence, the female cavity of the aerosol-generating article may have a cylindrical shape to enable insertion of the piston of the locking element into the cavity of the aerosol-generating article only if the aerosol-generating article is inserted in a specific orientation into the receiving region. Alternatively, if the orientation of the aerosol-generating article is of no concern, the female cavity of the aerosol-generating article may be a groove fully surrounding the outer circumference of the aerosol-generating article. For moving the piston, as any know means such as a linear motor may be employed. The controller may be configured to control movement of the piston, for example by controlling operation of the linear motor.

The locking element may comprise a piston movable in a lateral direction into a female cavity of the aerosol-generating article for securely holding the received aerosol-generating article in the receiving region, and wherein the locking element may comprise an electromagnet for holding the piston in a retracted position.

The electromagnet may be controlled by the controller. If the aerosol-generating article has been inserted into the receiving region, locking of the aerosol-generating article in place may be facilitated by the controller controlling the electromagnet to no longer hold the piston in the retracted position. The piston may then engage with the female cavity of the aerosol-generating article. In this aspect and in all aspects described herein, in which a piston is employed, the locking element may comprise a spring. The spring may be configured to bias the piston in the direction of the aerosol-generating article. Hence, the electromagnet may hold the piston in place and act against the biasing force of the spring. If the electromagnet is deactivated by the controller, the spring may push the piston in a lateral direction inwards towards the inner of the receiving region to engage with the female cavity of the aerosol-generating article. Furthermore, the aerosol-generating article may comprise a tapered distal end to facilitate pushing the piston into the retracted position during insertion of the aerosol-generating article into the receiving region. The tapered distal end of the aerosol-generating article may be utilized in all of the aspects described herein, in which a piston is employed. In this regard, the distal end of the aerosol-generating article may be the end which is inserted first into the receiving region and which may be arranged adjacent the base of the receiving region after full insertion of the aerosol-generating article into the receiving region. The tapered end may be utilized to push the piston into the retracted position, which may be beneficial, since in this case the piston does not need to be actively held in the retracted position by the electromagnet over time. In other words, the piston may be positioned in an extended state, reaching into the receiving region, if the aerosol-generating device is not operated. Then, if the aerosol-generating article comprising the tapered distal end is inserted into the receiving region, the tapered end of the aerosol-generating article may push the piston towards the retracted position. The piston may then be held in the retracted position by the electromagnet. Upon activation of the controller, the electromagnet may be deactivated so that the biasing spring of the locking element pushes the piston back towards the extended position. However, since the aerosol-generating article will now be fully inserted into the receiving region and be positioned in the desired optimal operation position, the piston will engage with the aerosol-generating article by engagement with the female cavity of the aerosol-generating article. In the retracted position, the piston may be retracted in a cavity of the locking element. In all embodiments described herein, in which a piston is utilized, instead of the locking element comprising the movable piston and the aerosol-generating article comprising the female cavity for engagement with the piston, the arrangement could be a vice versa. Thus, the aerosol-generating article may comprise the movable piston and a spring for biasing the movable piston and the locking element may comprise a female cavity for engagement with the piston of the aerosol-generating article. If an electromagnet is employed, the electromagnet may also be utilized for disengaging the locking elements from the aerosol-generating article. In this regard, after locking of the aerosol-generating article, the movable piston of the locking element will be received in the female cavity of the aerosol-generating article. If this engagement of the aerosol-generating article from the receiving region of the aerosol-generating device is desired, retraction of the piston is necessary. This retraction of the piston may be facilitated by again activating the electromagnet. In this case, the electromagnet will exert a force onto the piston which acts against the force of the biasing spring. The electromagnet is configured so that the force acting on the piston by means of the electromagnet is higher than the force of the biasing spring. Hence, the piston will then again be retracted into the retracted position and thus disengage with the female cavity of the aerosol-generating article. Afterwards, the aerosol-generating article can be removed from the receiving region of the aerosol-generating device. As described above, this operation will be utilized after heating operation, preferably after a predetermined time after heating operation, and more preferably after the aerosol-generating article is spent and insertion of a new aerosol-generating article into the receiving region is desired. If a movable piston is employed in the locking element, the locking element is preferably arranged near the side wall of the receiving region so that the piston can move in a lateral direction into the receiving region.

The locking element may comprise one or more of a rotatable hook and a rotatable cam configured to engage with the aerosol-generating article for securely holding the received aerosol-generating article in the receiving region.

The rotatable hook and the rotatable cam are a further possibility of facilitating the secure holding of the aerosol-generating article in the receiving region by means of the locking element. In this regard, the rotatable hook may be attached to the rotatable cam so that rotation of the rotatable cam facilitates a rotation of the rotatable hook. Rotation of the rotatable hook, on the other hand, securely holds the aerosol-generating article in place. For example, the rotatable hook may act as a male locking element, while the aerosol-generating article may comprise a corresponding female element for engagement with the rotatable hook of the locking element. The rotatable cam may be rotatable by any known means such as by a motor. For disengagement of the locking element with the aerosol-generating article, the rotatable cam may be rotated in an opposite direction so that the rotatable hook disengages with the corresponding female part of the aerosol-generating article. If a rotatable hook is employed in the locking element, the locking element may be arranged adjacent to the sidewall of the receiving region or at the base of the receiving region. In other words, the locking element may in this case be arranged adjacent any part of the receiving region, since the locking action between the locking element and the aerosol-generating article does not depend upon the orientation of the rotatable hook, since the rotatable hook may engage the corresponding female part of the aerosol-generating article in any orientation.

For rotation of the rotatable hook by means of rotating the rotatable cam, a motor may be employed. Alternatively, the rotatable hook may be rotated by means of rotating the rotatable cam, wherein the rotatable cam may be rotated by the user manually. Rotation of the rotatable cam may be enabled in a single direction only by employing a ratchet. If it is desired that the aerosol-generating article is detached from the receiving region by means of detaching the locking element from the aerosol-generating article, the ratchet may be disengaged so that the rotatable cam can be rotated in the opposite direction.

In any of the above aspects of the locking element, the locking element may comprise a male element and the aerosol-generating article may comprise a female element. The male element may be configured to engage with the female element to hold the aerosol-generating article in the desired optimal operation position. Also, instead of the locking element comprising the male element and the aerosol-generating article comprising the female element, the aerosol-generating article may comprise the male element and the locking element may comprise the female element. Specific elements mentioned above for the male element may be the movable piston and the rotatable hook. Corresponding female elements may be a cylindrical cavity for the movable piston and a shoulder or protrusion for the rotatable hook.

The locking element may comprise material configured to change its shape depending on the temperature of the material, preferably shape-memory material, more preferably at least one shape-memory alloy, and wherein said material may be configured to securely hold the received aerosol-generating article in the receiving region, when the atomiser heats said material.

The shape-changing material may be part of the locking elements in the aerosol-generating device or in the aerosol-generating article. The temperature dependency of the shape-changing material may be utilized to change the shape of the material, if the atomiser is operated. The increased temperature during operation of the atomiser may facilitate, that the shape-changing material changes its shape. The shape change of the shape-changing material however, may facilitate the secure holding of the aerosol-generating article in the receiving region. For example, the shape-changing material may realize a male locking element by increasing its volume during the shape change. The increased volume of the shape-changing material may reach into a corresponding female locking element. If the shape-changing material is provided in the aerosol-generating device, the temperature rise during operation of the atomiser may lead to the shape-changing material bulging or extending towards the aerosol-generating article. The aerosol-generating article may comprise a corresponding groove or cavity, into which the shape-changing material can extend. Alternatively, the aerosol-generating article comprises the shape-changing material and the aerosol-generating device comprises the corresponding groove or cavity.

The present invention also relates to an aerosol-generating system comprising an aerosol-generating device as described above and an aerosol-generating article as described above.

The present invention also relates to a method of manufacturing an aerosol-generating device, comprising:

- providing a receiving region for receiving an aerosol-generating article comprising aerosol-generating substrate,
- providing an atomiser for heating the aerosol-generating substrate of the aerosol-generating article, when the aerosol-generating article is received in the receiving region,
- providing a locking element for securely holding the received aerosol-generating article in the receiving region, and
- providing a controller,
- wherein the controller is configured to control the locking element to hold the aerosol-generating article, when the atomiser is activated.

The method may comprise insertion of the aerosol-generating article into the receiving region.

The method may comprise engaging of the locking element with the aerosol-generating article for holding the aerosol-generating article in the desired optimal operation position.

The method may comprise disengaging the locking element from the aerosol-generating article to enable removal of the aerosol-generating article from the receiving region.

The method may comprise engaging of a male locking element of the locking element with a female locking element of the aerosol-generating article or vice versa.

Features described in relation to one aspect may equally be applied to other aspects of the invention.

Figure 2:
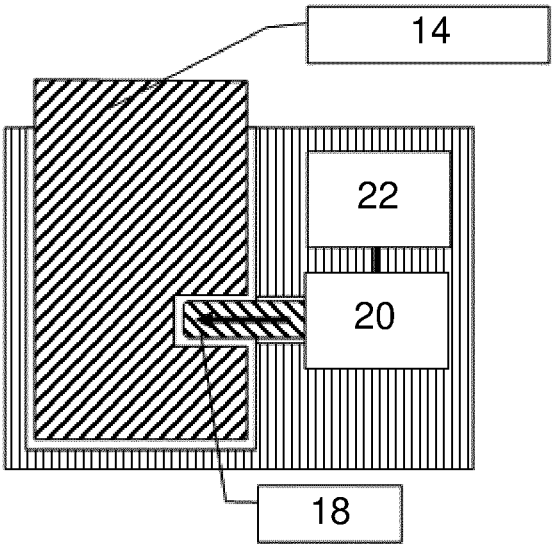
Figure 3:
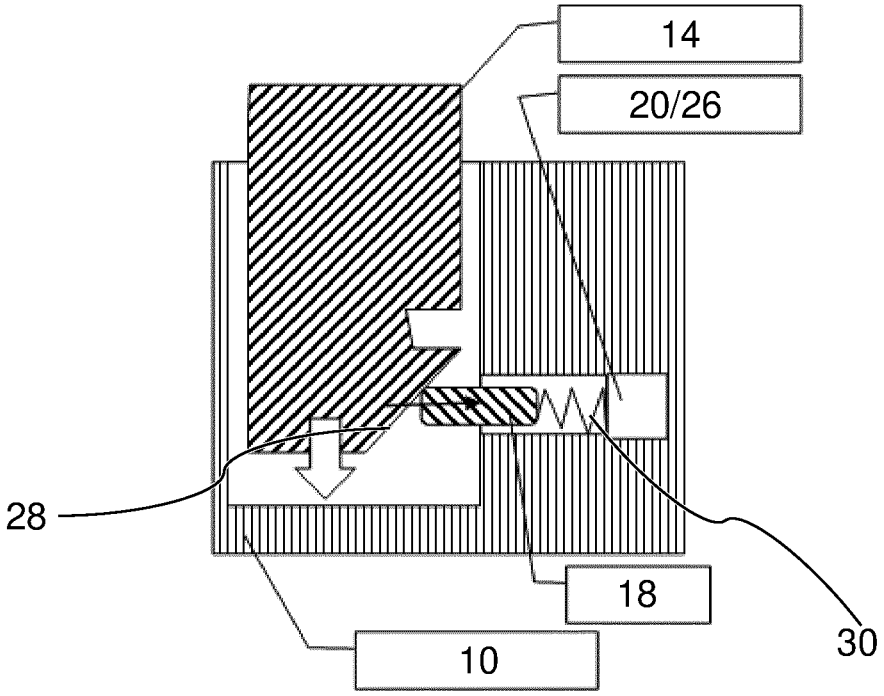
Figure 4:
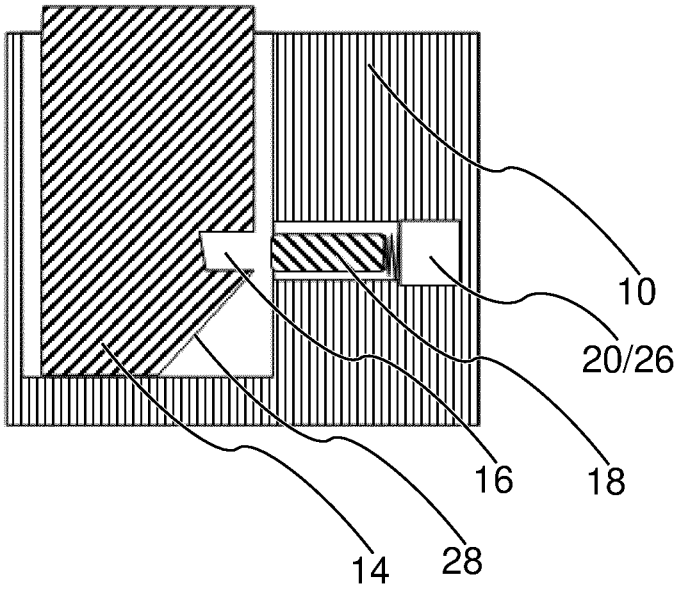
Figure 5:
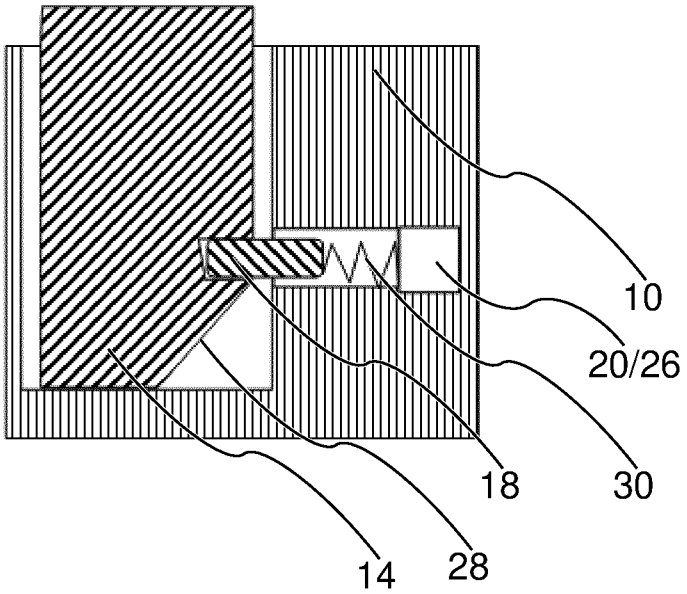
Figure 6:
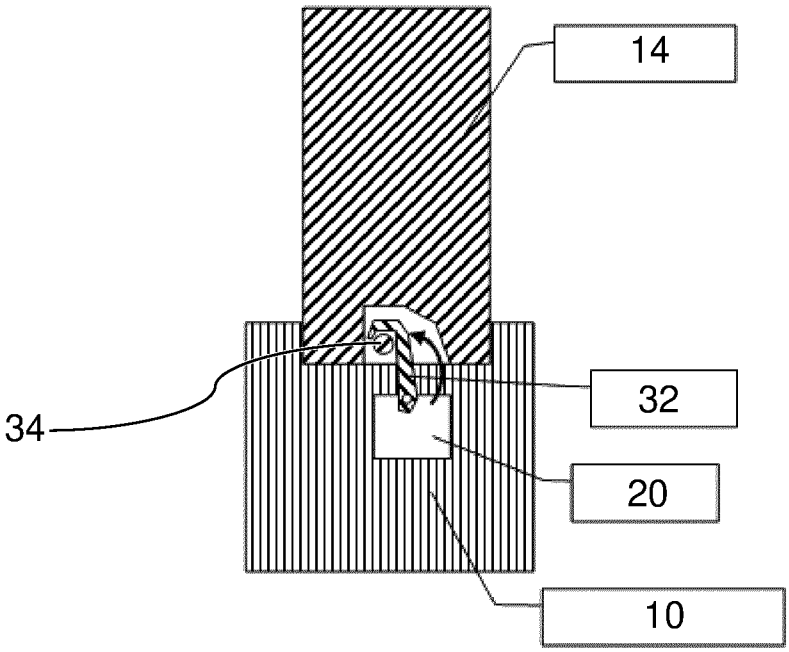
Figure 7:
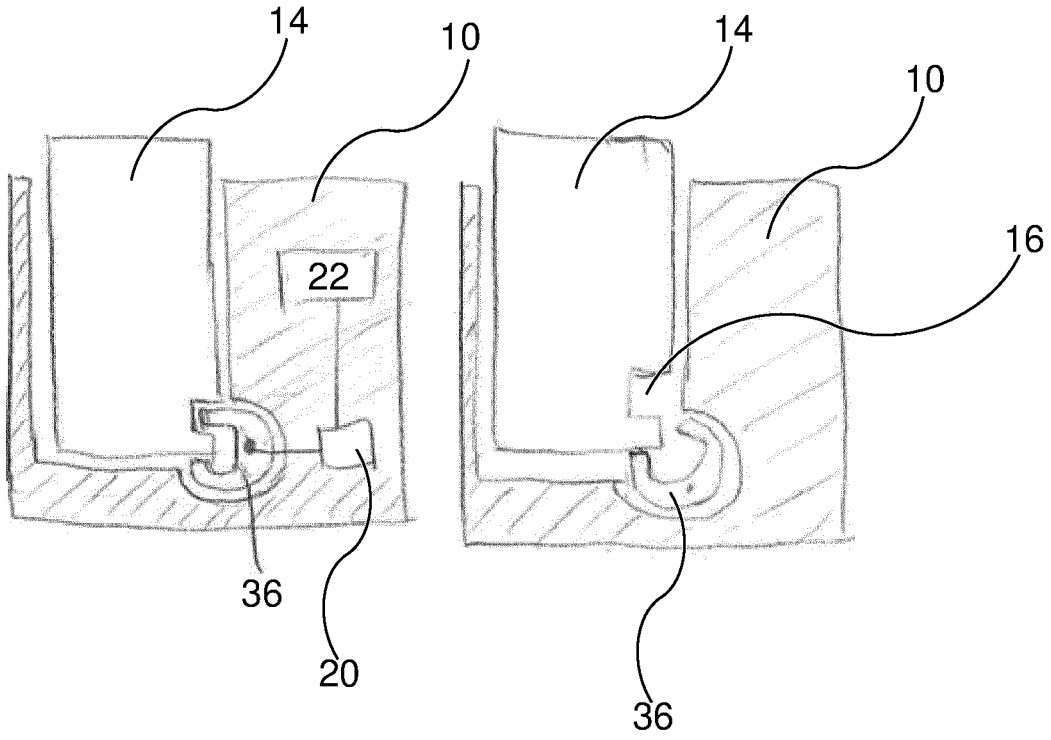
Figure 8:
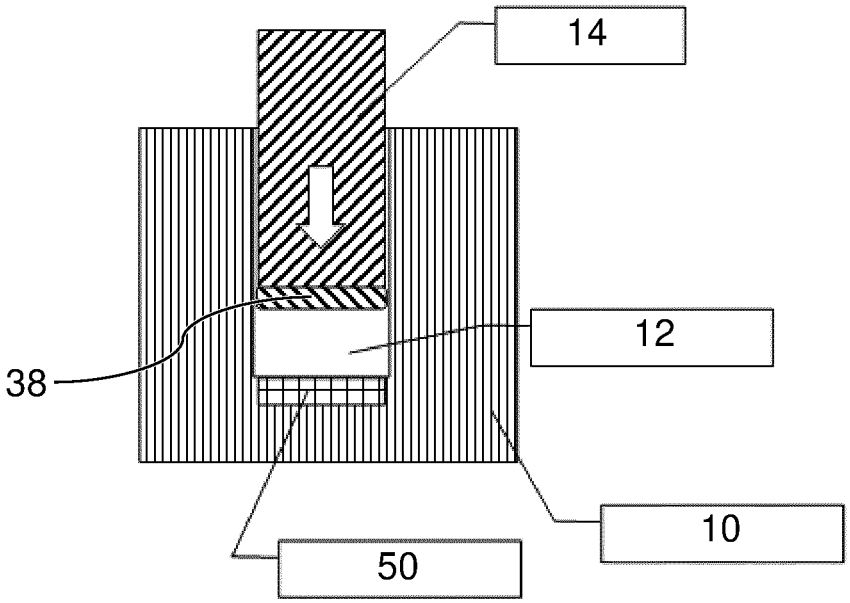
Figure 9:
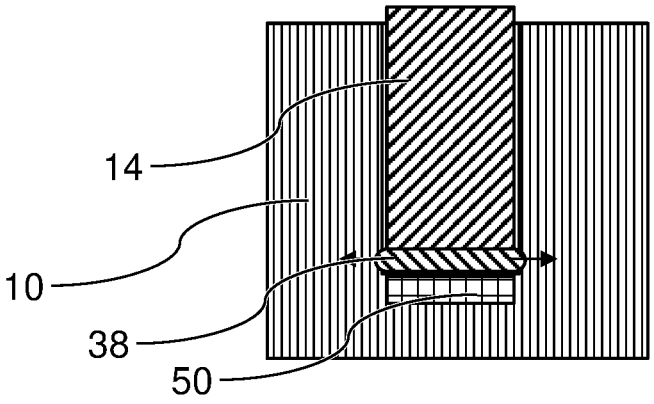

The invention will be further described, by way of example only, with reference to the accompanying drawings in which:

FIG. 1 shows an aerosol-generating device with a locking element for holding an aerosol-generating article, FIG. 2 shows the aerosol-generating device of FIG. 1 with engaged locking element, FIG. 3 shows the aerosol-generating device with a different locking element, FIG. 4 shows the aerosol-generating device of FIG. 3 after insertion of the aerosol-generating article, FIG. 5 shows the aerosol-generating device of FIGS. 3 and 4 with engaged locking element, FIG. 6 shows the aerosol-generating device with a further different locking element, FIG. 7 shows the aerosol-generating device by FIG. 6 with further details of the locking element, FIG. 8 shows the aerosol-generating device with a further different locking element, and FIG. 9 shows the aerosol-generating device of FIG. 8 with engaged locking element.

FIG. 1 shows an aerosol-generating device 10 comprising a receiving region 12. The receiving region 12 is configured as an atomising chamber and has the shape of a cavity. Preferably, the receiving region 12 has a circular cross-section and has a cylindrical shape. The receiving region 12 is provided for insertion of an aerosol-generating article 14. The aerosol-generating article 14 preferably has a shape corresponding to the shape of the receiving region 12. Preferably, the aerosol-generating article 14 has a cylindrical shape.

The aerosol-generating article 14 comprises a female cavity 16. The female cavity 16 is shaped so that a piston 18 of the aerosol-generating device 10 can be inserted into the female cavity 16 of the aerosol-generating article 14. The piston 18 is part of a locking element 20 of the aerosol-generating article 14. The piston 18 is configured movable. The piston 18 is configured laterally movable. The piston 18 is configured to hold the aerosol-generating article 14 in place, when the piston 18 is extended into the female cavity 16 of the aerosol-generating article 14. In FIG. 1, the aerosol-generating article 14 is depicted in a fully received state in the receiving region 12. This fully received state is a desired optimal operation position of the aerosol-generating article 14. In this position, the atomiser (not shown) of the aerosol-generating device 10 is configured to atomise the aerosol-generating substrate contained in the aerosol-generating article 14. For facilitating secure holding of the aerosol-generating article 14 in this desired optimal operation position, the locking element 20 is provided. If the aerosol-generating article 14 has been fully inserted into the receiving region 12, the locking element 20, more particularly the piston 18 of the locking element 20, extends into the female cavity 16 of the aerosol-generating article 14 to securely hold the aerosol-generating article 14 in place.

For controlling the locking element 20, a controller 22 is provided. The controller 22 is provided to control the locking element 20 to move the piston 18 into the female cavity 16 of the aerosol-generating article 14 for holding the aerosol-generating article 14. Furthermore, the piston 18 can be retracted in the initial position as shown in FIG. 1. For attracting the piston 18 from the female cavity 16 of the aerosol-generating article 14, also the controller 22 may be employed. FIG. 1 also shows a power supply 24 for powering the locking element 20 as well as the atomiser and the controller 22. The power supply 24 is preferably configured as a battery.

The locking element 20 is preferably configured as an electrical locking element 20. The locking element 20 may comprise a motor for moving the piston 18. The motor may be configured to move the piston 18 from the retracted state into the extended state for holding the aerosol-generating article 14 in place. The motor may be configured for retracting the piston 18 from the extended state into the retracted state for enabling the removal of the aerosol-generating article 14 from the receiving region 12.

In the aspect shown in FIG. 1, the female cavity 16 of the aerosol-generating article 14 is provided at a specific position of the aerosol-generating article 14. This aspect may be preferred, if the aerosol-generating article 14 should be inserted and held in the receiving region 12 in a specific orientation. Alternatively, the female cavity 16 may be configured as a groove fully surrounding the outer circumference of the aerosol-generating article 14 so that the aerosol-generating article 14 may be inserted in an arbitrary orientation into the receiving region 12 and held therein by the piston 18 of the locking element 20. In other words, rotation of the aerosol-generating article 14 would be enabled, even if the piston 18 would extend into the female cavity 16 of the aerosol-generating article 14, while removal of the aerosol-generating article 14 from the receiving region 12 would still be prevented.

FIG. 2 shows the piston 18 in the extended state, in which the piston 18 extends into the female cavity 16 of the aerosol-generating article 14.

In FIG. 3, a further aspect of the invention is shown, in which the locking element 20 also comprises a piston 18. Additionally, the locking element 20 comprises an electromagnet 26. The electromagnet 26 is configured to hold the piston 18 in the retracted position, in which the piston 18 is not extended into the receiving region 12, but held in the locking element 20. The electromagnet 26 may be connected with the power supply 24 for activating and deactivating the electromagnet 26. The electromagnet 26 may be activated, if a connection is established between the power supply 24 and the electromagnet 26. The activation and deactivation of the electromagnet 26 may be controlled by the controller 22. According to this aspect, the aerosol-generating article 14 may comprise a tapered end 28. The tapered end 28 of the aerosol-generating article 14 may be configured to push the piston 18 towards the retracted position during insertion of the aerosol-generating article 14 into the receiving region 12. When the aerosol-generating article 14 is fully inserted into the receiving region 12 in the desired optimal operation position, the piston 18 is preferably fully pushed into the retracted position by the tapered end 28 of the aerosol-generating article 14. Once the piston 18 is pushed into the retracted position, the electromagnet 26 may be configured to hold the piston 18 in this retracted position. In other words, before insertion of the aerosol-generating article 14, the piston 18 may extend into the receiving region 12 and the electromagnet 26 may be deactivated. Alternatively, the piston 18 may be held in the retracted position by the electromagnet 26 at all times.

As can further be seen in FIG. 3, a biasing spring 30 is provided. The biasing spring 30 is preferably provided for biasing the piston 18 in the direction of the receiving region 12. The biasing spring 30 may be arranged between the electromagnet 26 and the piston 18. Hence, the electromagnetic force created by the electromagnet 26, if activated, acting on the piston 18 may act on the piston 18 in a direction perpendicular to the biasing force of the spring.

During insertion of the aerosol-generating article 14 into the receiving region 12, the tapered end 28 of the aerosol-generating article 14 may push the piston 18 into the retracted state against the biasing force of the biasing spring 30.

As can be seen in FIG. 4, after full insertion of the aerosol-generating article 14, the piston 18 is positioned in the retracted state and held by the electromagnet 26.

FIG. 5 shows the arrangement of the piston 18 engaged with the female cavity 16 of the aerosol-generating article 14, after the electromagnet 26 has been deactivated by the controller 22. After deactivation of the electromagnet 26, the biasing spring 30 pushes the piston 18 towards and into the receiving region 12 so that the piston 18 engages with the female cavity 16 of the aerosol-generating article 14.

FIG. 6 shows a further embodiment, in which the locking element 20 comprises a rotatable hook 32. The rotatable hook 32 is engageable with a corresponding female locking element 34 of the aerosol-generating article 14. As shown in FIG. 6, the locking element 20 may in this case be arranged at the base of the receiving region 12.

In FIG. 7, the locking element 20 is arranged at a bottom edge of the receiving region 12. Due to the insertion of the aerosol-generating article 14 into the receiving region 12, the aerosol-generating article 14 may push the locking element 20. The locking element 20 in this case provided as a rotatable locking element 36. Pushing the rotatable locking element 36 may rotate the locking element 20 so that a protrusion of the locking element 20 engages with the female cavity 16 of the aerosol-generating article 14. After this rotation, the aerosol-generating device 10 may be configured to block the further rotation of the locking element 20 so that the aerosol-generating article 14 is securely held in the receiving region 12. The locking action may be realized by a ratchet. If a ratchet is utilized for disengaging the locking element 20 from the aerosol-generating article 14, the controller 22 may be configured to disengage the ratchet. Any other means for locking the rotatable locking element 36 may be utilized.

FIG. 8 shows an aspect, in which the locking element 20 is realized by a shape-changing element 38. In this regard, the locking element 20 comprises the shape changing element for holding the aerosol-generating article 14 in place. As can be seen in FIG. 8, an atomiser 50 comprising a heating element is provided at the base of the receiving region 12. The locking element 20 is in this aspect provided at the aerosol-generating article 14, more precisely at the distal end of the aerosol-generating article 14. Alternatively, the shape-changing element 38 may be part of the aerosol-generating device 10. In this case, the shape-changing element 38 may be arranged adjacent to the atomiser 50. The shape changing element may be arranged at the base of the receiving region 12. The shape-changing element 38 of the locking element 20 may be configured as a shape-memory material, particularly a shape-changing alloy.

In FIG. 9, the operation of the locking element 20 of the aspect shown in FIG. 8 is depicted. When the aerosol-generating article 14 is fully inserted into the receiving region 12, the atomiser 50 may be operated. The atomiser 50 is operated for heating the aerosol-generating substrate contained in the aerosol-generating article 14. Additionally, the atomiser 50 heats the shape-changing element 38 of the locking element 20. Due to the heating of the shape-changing element 38 by the atomiser 50, the shape-changing element 38 is expanding in the direction of the sidewall of the receiving region 12. The receiving region 12 may have a corresponding groove or cavity for enabling the additional volume of the shape-changing element 38 to extend into the groove or cavity. The locking action of the locking element 20 is facilitated by this additional volume of the shape-changing element 38 extending into the groove or cavity. After the heating operation, the heating element 40 cools down. The cooling down of the atomiser 50 also results in the shape-changing element 38 resuming its initial shape. After that, the aerosol-generating article 14 can be removed from the receiving region 12, and a new aerosol-generating article 14 can be inserted into the receiving region 12.

The invention claimed is:

1. An aerosol-generating device comprising:

a receiving region configured to receive an aerosol-generating article comprising aerosol-generating substrate, an atomiser configured to atomise the aerosol-generating substrate of the aerosol-generating article, when the aerosol-generating article is received in the receiving region, a locking element configured to securely hold the received aerosol-generating article in the receiving region, and a controller, wherein the controller is configured to control the locking element to hold the aerosol-generating article, when the atomiser is activated, and wherein the controller is configured to control the locking element to release the aerosol-generating article, when the atomiser is deactivated.

2. The aerosol-generating device according to claim 1, wherein the locking element is configured to securely hold the received aerosol-generating article in the receiving region in a specific position.

3. The aerosol-generating device according to claim 1, wherein the controller is configured to control the locking element to release the aerosol-generating article, when the atomiser is deactivated and a predetermined time has elapsed.

4. The aerosol-generating device according to claim 1, wherein the controller is configured to prevent one or more of activation and operation of the atomiser, if the locking element is unable to securely hold the received aerosol-generating article in the receiving region.

5. The aerosol-generating device according to claim 1, wherein the device further comprises an article sensor configured to detect whether the aerosol-generating article is received in the receiving region.

6. The aerosol-generating device according to claim 5, wherein the controller is configured to control the locking element to hold the aerosol-generating article, when the atomiser is activated and when the article sensor detects that the aerosol-generating article is received in the receiving region.

7. The aerosol-generating device according to claim 5, wherein the controller is configured to prevent activation of the atomiser, if the article sensor detects that the aerosol-generating article is not received in the receiving region.

8. The aerosol-generating device according to claim 1, wherein the device further comprises an unlock enabling element which is configured to enable the locking element to be mechanically unlocked.

9. The aerosol-generating device according to claim 1, wherein the locking element is configured to enable transfer of electrical energy from the aerosol-generating device to the aerosol-generating article, when the locking element securely holds the received aerosol-generating article in the receiving region.

10. The aerosol-generating device according to claim 1, wherein the locking element is electrically operated and utilizes a common electric circuit with the atomiser.

11. The aerosol-generating device according to claim 1, wherein the locking element is electrically operated and comprises a piston movable in a lateral direction into a female cavity of the aerosol-generating article for securely holding the received aerosol-generating article in the receiving region.

12. The aerosol-generating device according to claim 1, wherein the locking element comprises a piston movable in a lateral direction into a female cavity of the aerosol-generating article for securely holding the received aerosol-generating article in the receiving region, and wherein the locking element comprises an electromagnet for holding the piston in a retracted position.

13. The aerosol-generating device according to claim 1, wherein the locking element comprises one or more of a rotatable hook and a rotatable cam configured to engage with the aerosol-generating article for securely holding the received aerosol-generating article in the receiving region.

14. The aerosol-generating device according to claim 1, wherein the atomiser comprises a heating element configured to heat the aerosol-generating substrate of the aerosol-generating article, wherein the locking element comprises material configured to change its shape depending on the temperature of the material, and wherein said material is configured to securely hold the received aerosol-generating article in the receiving region, when the atomiser heats said material.

15. The aerosol-generating device according to claim 1, wherein the atomiser comprises a heating element configured to heat the aerosol-generating substrate of the aerosol-generating article, wherein the locking element comprises material configured to change its shape depending on the temperature of the material, the material comprising a shape-memory material and wherein said material is configured to securely hold the received aerosol-generating article in the receiving region, when the atomiser heats said material.

16. The aerosol-generating device according to claim 1, wherein the atomiser comprises a heating element configured to heat the aerosol-generating substrate of the aerosol-generating article, wherein the locking element comprises material configured to change its shape depending on the temperature of the material, the material comprising at least one shape-memory alloy, and wherein said material is configured to securely hold the received aerosol-generating article in the receiving region, when the atomiser heats said material.

* * * * *